US009963214B2

(12) United States Patent
Watanabe et al.

(10) Patent No.: US 9,963,214 B2
(45) Date of Patent: May 8, 2018

(54) SHIP HANDLING DEVICE

(71) Applicant: YANMAR CO., LTD., Osaka-shi, Osaka (JP)

(72) Inventors: Jun Watanabe, Osaka (JP); Gakuji Tamura, Osaka (JP); Hiroaki Wakahara, Osaka (JP); Naohiro Hara, Osaka (JP)

(73) Assignee: YANMAR CO., LTD., Osaka-Shi, Osaka (JP)

( * ) Notice: Subject to any disclaimer, the term of this patent is extended or adjusted under 35 U.S.C. 154(b) by 0 days. days.

(21) Appl. No.: 15/520,644

(22) PCT Filed: Aug. 24, 2015

(86) PCT No.: PCT/JP2015/073667
§ 371 (c)(1),
(2) Date: Apr. 20, 2017

(87) PCT Pub. No.: WO2016/063611
PCT Pub. Date: Apr. 28, 2016

(65) Prior Publication Data

US 2017/0305520 A1 Oct. 26, 2017

(30) Foreign Application Priority Data

Oct. 23, 2014 (JP) ..... 2014-216748

(51) Int. Cl.
*B63H 21/21* (2006.01)
*B63H 25/02* (2006.01)
*B63H 25/42* (2006.01)

(52) U.S. Cl.
CPC ..... *B63H 21/21* (2013.01); *B63H 25/02* (2013.01); *B63H 25/42* (2013.01)

(58) Field of Classification Search
CPC ..... B63H 21/21; B63H 23/00; B63H 23/30; B63H 25/02; B63H 25/42; B63C 11/02; G06F 17/00
(Continued)

(56) References Cited

U.S. PATENT DOCUMENTS

| | | | | |
|---|---|---|---|---|
| 8,019,498 | B2 | 9/2011 | Yamazaki et al. | |
| 2010/0121505 | A1 | 5/2010 | Yamazaki et al. | |
| 2011/0172858 | A1* | 7/2011 | Gustin ..... | B63H 25/02 701/21 |

FOREIGN PATENT DOCUMENTS

| | | | |
|---|---|---|---|
| JP | 2008184127 | A | 8/2008 |
| JP | 2008222082 | A | 9/2008 |
| WO | 2007010767 | A1 | 1/2007 |

OTHER PUBLICATIONS

International Search Report corresponding to Application No. PCT/JP2015/073667; dated Nov. 2, 2015, with English translation.

* cited by examiner

*Primary Examiner* — Lars A Olson
(74) *Attorney, Agent, or Firm* — Cantor Colburn LLP

(57) ABSTRACT

The purpose is providing a ship handling device easily determining a predetermined correction coefficient regardless of positions of a side thruster and a forward/backward propeller and the center of gravity of a ship and the shape of the ship. The device is provided with a joystick lever for indicating a propulsion direction and the magnitude of thrust by tilting direction and angle, wherein: a lateral movement thrust is generated by the side thruster in accordance with the joystick lever; a first correction thrust is generated by the forward/backward propeller in accordance with the joystick lever so as to cancel out a rotation moment; and a first correction coefficient for calculating a first correction thrust with respect to the lateral movement thrust is determined.

2 Claims, 7 Drawing Sheets

(58) Field of Classification Search
USPC ..... 440/1, 84; 701/21
See application file for complete search history.

SHIP HANDLING DEVICE

CROSS REFERENCE TO RELATED APPLICATIONS

This is the U.S. national stage of application No. PCT/JP2015/073667, filed on Aug. 24, 2015. Priority under 35 U.S.C. § 119(a) and 35 U.S.C. § 365(b) is claimed from Japanese Application No. 2014-216748, filed Oct. 23, 2014, the disclosure of which is also incorporated herein by reference.

TECHNICAL FIELD

The present invention relates to a ship handling device. More specifically, the present invention relates to a ship handling device for a ship that includes a side thruster and has power transmitted from a transmission disposed in a ship body to a forward/backward propeller through a propeller shaft.

BACKGROUND ART

In one conventionally known ship (shaft ship), power is transmitted from an engine, provided in a ship body, to a forward/backward propeller, provided outside the ship body, via a switching clutch and a propeller shaft. Furthermore, in another known ship, a side thruster is provided for causing the ship to laterally move left or right to achieve higher operability at the time of docking or the like. The side thruster includes a propeller provided around the center of a bow side in a left and right direction so that thrust is generated in the left and right direction. Thus, the ship is configured to be laterally movable by the side thruster, whereby a docking operation can be easily performed.

When the ship with such a configuration moves in a desired direction, a rotation moment acts on the ship due to a relationship between a position of the ship corresponding to the center of gravity and thrust generated by the side thruster. Thus, the ship makes a lateral movement with the ship handling device performing rotation correction with the thrust generated by the side thruster and thrust generated by the forward/backward propeller, as well as correction thrust generated by the forward/backward propeller. Thus, the ship handling device controls the movement of the ship by controlling each of the side thruster and the forward/backward propeller (engine). This is described in Patent Literature 1 for example.

The ship handling device described in Patent Literature 1 is required to change a control mode for moving the ship in the desired direction, in accordance with the position of the side thruster with respect to the center of gravity position of the ship, the shape of a ship body, and the like. Thus, the relationship between the thrust generated by the side thruster and the thrust generated by the forward/backward propeller does not hold true in a ship that does not correspond to the condition of the experiment and the calculation for determining the control mode or when the side thruster and the forward/backward propeller are provided at unexpected positions. In such a case, an operator needs to control each of the thrust generated by the side thruster and the thrust generated by the forward/backward propeller.

CITATION LIST

Patent Literature

PTL 1: Japanese Unexamined Patent Application Publication No. 2008-222082

SUMMARY OF INVENTION

Technical Problem

The present invention is made in view of the above, and an object of the present invention is to provide a ship handling device in which a predetermined correction coefficient can be easily determined, regardless of the positional relationship between the side thruster and the forward/backward propeller and the center of gravity of the ship and regardless of the shape of the ship.

Solution to Problem

An object of the present invention is as described above, and means for achieving the object is described below.

Specifically, in the present invention, a ship handling device for a ship, the ship handling device being disposed in a ship body and provided with a forward/backward propeller for generating thrust in forward and backward direction of the ship by power transmitted from an engine via a propeller shaft and a side thruster for generating thrust in left and right direction of the ship, and including: a joystick lever for indicating a propulsion direction of the ship and magnitude of thrust by way of a tilt direction and a tilt angle and indicating a direction and magnitude of moment generated by the ship from thrust by way of a rotation direction and a rotation amount. A lateral movement thrust is generated by the side thruster in accordance with a tilting operation of the joystick lever in one left and right direction, a first correction thrust is generated by the forward/backward propeller in accordance with a rotating operation of the joystick lever so as to cancel out a moment generated by the lateral movement thrust, and a first correction coefficient for calculating a first correction thrust with respect to the lateral movement thrust is determined.

In the present invention, a left and right direction force component of oblique movement thrust generated by the side thruster may be generated in accordance with an operation amount in a left and right direction in the tilting operation on the joystick lever in a desired oblique direction, and a forward and backward direction force component of oblique movement thrust generated by the forward/backward propeller may be generated in accordance with an operation amount in the forward and backward direction in the tilting operation on the joystick lever in the desired oblique direction. The first correction thrust based on the first correction coefficient may be further generated by the forward/backward propeller with respect to the left and right direction force component, and second correction thrust may be further generated by the forward/backward propeller and third correction thrust may be further generated by the side thruster in accordance with a rotating operation performed on the joystick lever for canceling out a moment generated by an oblique movement of the ship. A second correction coefficient for calculating a second correction thrust with respect to forward and backward direction force component and a third correction coefficient for calculating a third correction thrust with respect to left and right direction force component may be determined.

Advantageous Effects of Invention

The present invention provides the following advantageous effects.

In the present invention, when the rotating operation is performed on the joystick in such a manner that the rotation moment involved in the lateral movement is canceled out, a thrust difference between the port side forward/backward propeller and the starboard side forward/backward propeller is set based on the thrust generated by the side thruster. Thus, the predetermined correction coefficient can be easily determined, regardless of the positional relationship between the side thruster and the forward/backward propeller and the center of gravity of the ship and regardless of the shape of the ship.

In the present invention, when the rotating operation is performed on the joystick in such a manner that the rotation moment involved in the oblique movement is canceled out, the thrust difference between the port side forward/backward propeller and the starboard side forward/backward propeller and the thrust generated by the thrust are set based on the thrust generated by the side thruster and the thrust generated by the forward/backward propeller. Thus, the predetermined correction coefficient can be easily determined, regardless of the positional relationship between the side thruster and the forward/backward propeller and the center of gravity of the ship and regardless of the shape of the ship.

DESCRIPTION OF EMBODIMENTS

Figure 1:
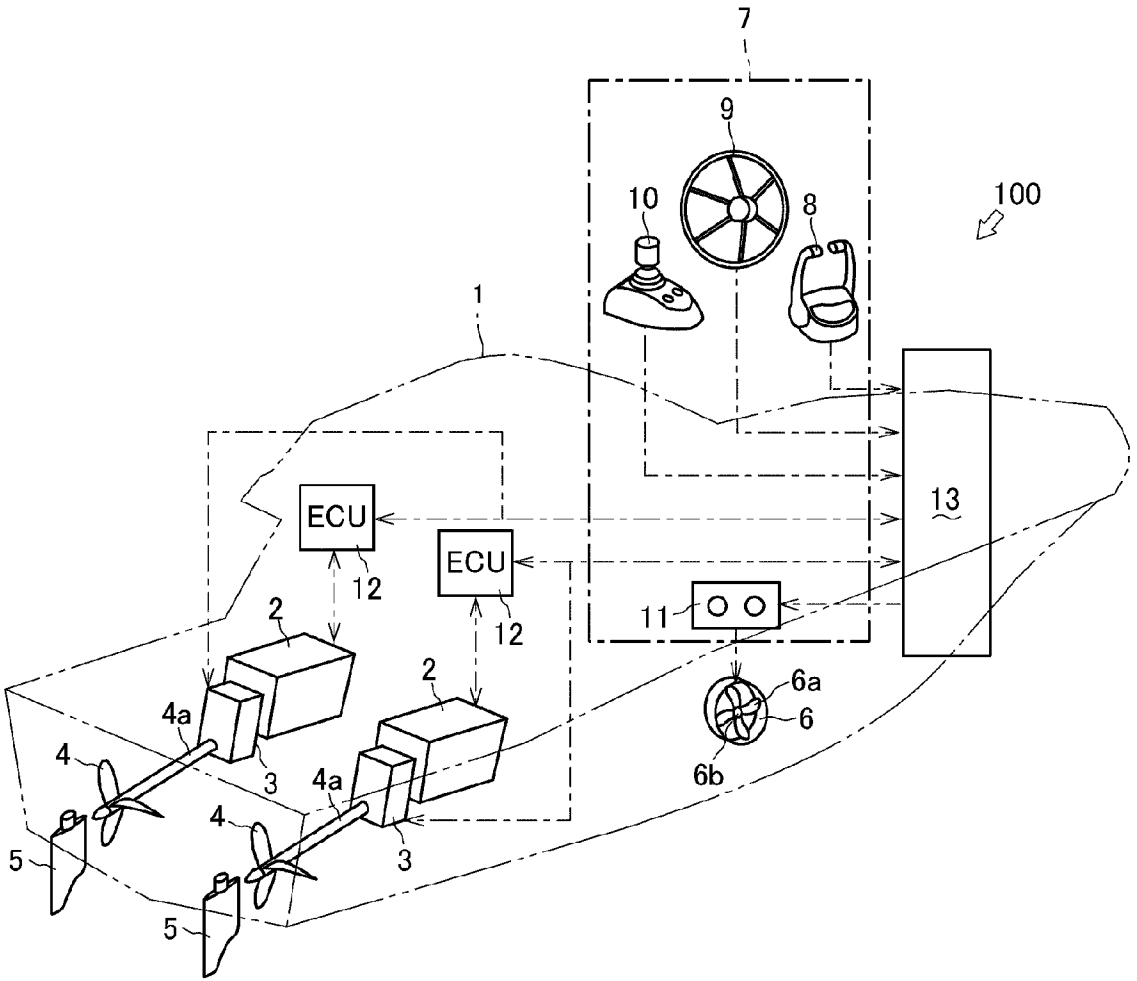
FIG. 1 is a schematic view illustrating an overview of a ship including a ship handling device according to the present invention.

First of all, an overview schematic configuration of a ship 100 as a first embodiment of the present invention is described with reference to FIG. 1 to FIG. 3. The ship 100 illustrated in FIG. 1 is what is known as a twin-screw ship. However, the number of propeller shafts is not limited to this. Other configurations including a plurality of shafts may be employed. In the present embodiment, a forward and backward direction and a left and right direction are defined with a bow direction of the ship 100 defined as the front.

Figure 2:
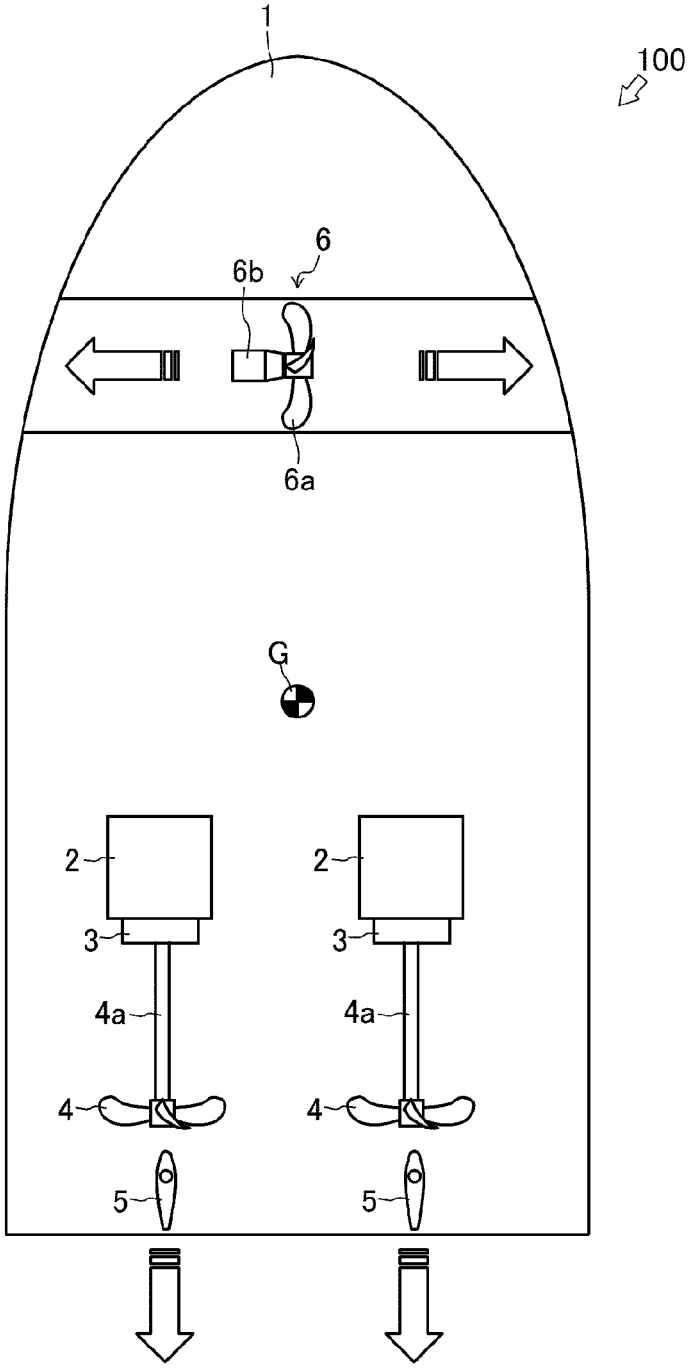
FIG. 2 is a schematic plan view illustrating an arrangement of a side thruster and forward/backward propellers of the ship including the ship handling device according to the present invention.

As illustrated in FIG. 1 and FIG. 2, the ship 100 is a shaft ship in which power from engines 2 is transmitted to forward/backward propellers 4 via propeller shafts 4*a*. The ship 100 includes a ship body 1 provided with: driving mechanisms including the engines 2, switching clutches 3, the forward/backward propellers 4, rudders 5, and a side thruster 6; a ship handling device 7 including an acceleration lever 8, a steering wheel 9, a joystick lever 10, a side thruster controller 11 and a ship handling control device 13; and an ECU 12. The ship 100 is not limited to the configuration of the present embodiment in which the driving mechanisms are provided on a port side and a starboard side.

The two engines 2 each generate the power for rotating a corresponding one of the forward/backward propellers 4 on the port side and the starboard side. The engines 2 are respectively disposed on a port rear side and a starboard rear side of the ship body 1. The engines 2 each have an output shaft to which a corresponding one of the switching clutches 3 is connected.

The two switching clutches 3 switch the power, transmitted from the output shafts of the engines 2, between a normal rotation direction and a reverse rotation direction, and output the resultant power. The switching clutch 3 has an input side connected to the output shaft of the engine 2. The switching clutches 3 each have an output side connected to a corresponding one of the propeller shafts 4*a*. Thus, the switching clutch 3 is configured to transmit the power from the engine 2 to the propeller shaft 4*a*.

The two forward/backward propellers 4 generate thrust in the forward and backward direction. The forward/backward propellers 4 are respectively connected to the two propeller shafts 4*a* provided through the bottom of the ship body 1 on the port side and the starboard side to extend outside the ship. The forward/backward propellers 4 are drivingly rotated by the power transmitted thereto through the propeller shafts 4*a* from the engines 2, and the thrust is generated with a plurality of blades, arranged around the rotation shafts, rotating in water in the periphery.

The two rudders 5 change the direction of a water flow generated by the forward/backward propellers 4 drivingly rotated. The rudders 5 are respectively disposed at a port side bottom rear end (stern side) and at a starboard side bottom rear end (stern side) of the ship body 1 on the rear side of the forward/backward propeller 4. The rudder 5 is configured to be pivotable within a predetermined angle range in the left and right direction about a pivoting shaft provided on the ship body 1. The rudders 5 are coupled to the steering wheel 9 in an interlocking manner. Thus, the rudders 5 are configured in such a manner that when the steering wheel 9 is operated to make a rudder rear end portion directed rightward of the ship body 1, the thrust generated by the water flow makes the stern of the ship 100 biased leftward and a bow side directed rightward. Similarly, the rudders 5 are configured in such a manner that when the steering wheel 9 is operated to make the rudder rear end portion directed leftward of the ship 100, the thrust generated by the water flow makes the stern of the ship 100 biased rightward and the bow side directed leftward.

The side thruster 6 generates thrust in the left and right direction. The side thruster 6 is disposed on the bow side of the ship body 1 and at the center in the left and right direction. The side thruster 6 includes a propeller 6*a* and a motor 6*b*. The motor 6*b* is connected to the side thruster controller 11, and is configured to be rotatable at a desired rotation speed. The side thruster 6 is configured in such a manner that the propeller 6*a* generates the thrust in the left and right direction of the ship body 1. The side thruster 6 drives the motor 6*b* based on a signal from the side thruster controller 11, whereby the propeller 6*a* is rotated so that the thrust of a desired magnitude is generated in the left and right direction.

The acceleration lever 8 as a part of the ship handling device 7 generates a signal indicating the rotation speed of the forward/backward propeller 4 on the port side and the rotation speed of the forward/backward propeller 4 on the starboard side, as well as their rotation direction. The acceleration lever 8 includes a lever corresponding to the forward/backward propeller 4 on the port side and a lever corresponding to the forward/backward propeller 4 on the starboard side. Thus, the acceleration lever 8 is configured to generate the signals for the forward/backward propeller 4 on the port side and for the forward/backward propeller 4 on the starboard side independently from each other. The acceleration lever 8 is configured to be tilted in the forward and backward direction of the ship 100 by a desired angle. The acceleration lever 8 is configured to generate a signal indicating the rotation speed of the engines 2 and a signal indicating a corresponding switching state of the switching clutch 3 independently from each other, in accordance with an operation direction and the amount of the operation. The acceleration lever 2 generates a signal for causing the forward/backward propellers 4 to generate the thrust with which the ship 100 travels forward when operated to be tilted forward, and generates a signal for causing the forward/backward propellers 4 to generate the thrust with which the ship 100 travels backward when operated to be tilted backward.

The steering wheel 9 as a part of the ship handling device 7 is used for changing the pivot angle of the rudders 5. The steering wheel 9 is coupled to the rudders 5 on the port side and on the starboard side in an interlocking manner via a wire link mechanism or a hydraulic circuit. When the steering wheel 9 is rotationally operated rightward, the rudders 5 pivot to have the rear end portions directed rightward. Thus, the water flow generated by the forward/backward propellers 4 is directed rightward so that the ship 100 has the stern biased leftward to have the bow side directed rightward. Similarly, when the steering wheel 9 is rotationally operated leftward, the rudders 5 pivot to have the rear end portions directed leftward. Thus, the water flow generated by the forward/backward propeller 4 is directed leftward so that the ship 100 has the stern biased rightward to have the bow side directed leftward.

Figure 3:
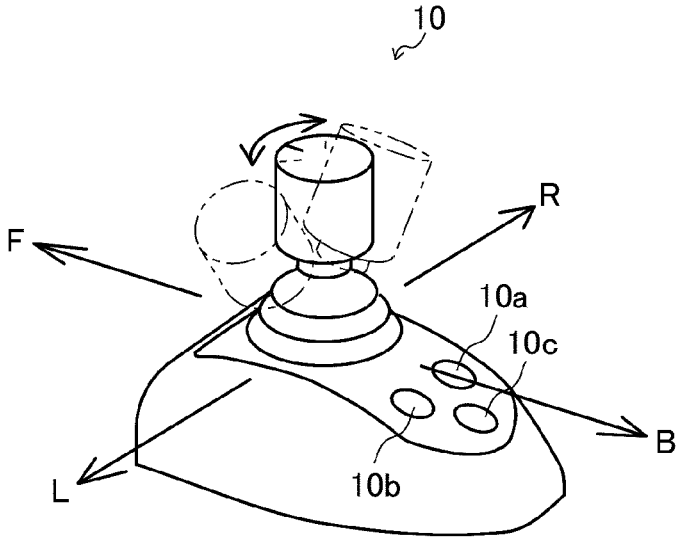
FIG. 3 is a perspective view illustrating a configuration of a joystick lever of the ship handling device according to the present invention.

As illustrated in FIG. 1 and FIG. 3, the joystick lever 10 as a part of the ship handling device 7 generates a signal for causing the ship 100 to move in a desired direction. The joystick lever 10 is configured to be capable of being tilted in a desired direction by a desired angle. The joystick lever 10 can be operated to be rotated by a desired angle about a lever shaft. The joystick lever 10 is configured to generate: a signal indicating the rotation speed of the engine 2 and the switching state of the switching clutch 3 in accordance with the operation mode and the amount of operation; and a signal indicating the rotation speed and the rotation direction of the side thruster 6. More specifically, the joystick lever 10 operated to be tilted in a desired direction generates a signal for the forward/backward propellers 4 on both sides and for the side thruster 6, to cause the ship 100 to move in the direction corresponding to the operation direction with the thrust corresponding to the amount of the operation. The joystick lever 10 operated to rotate about the lever shaft generates a signal for the forward/backward propellers 4 on both sides and for the side thruster 6, to cause the ship 100 to turn in a desired direction with the thrust corresponding to the amount of the operation.

The joystick lever 10 is provided with: a lateral movement mode switch 10*a* for performing correction for a lateral movement; an oblique movement mode switch 10*b* for performing correction for an oblique movement; and a correction executing switch 10*c*. Under a normal operation, the joystick lever 10 generates a signal, transmitted to the forward/backward propellers 4 on both sides and to the side thruster 6, for moving the ship 100 in a desired direction with thrust corresponding to the operation amount. When the lateral movement mode switch 10*a* is operated, the joystick lever 10 generates a signal, transmitted to the side thruster 6, for moving the ship 100 in a desired direction in accordance with a mode with a predetermined thrust Tt. When the correction executing switch 10*c* is operated, a correction value is determined based on the control mode in the lateral movement mode or the oblique movement mode, and a setting value is corrected based on the correction value.

The side thruster controller 11 as a part of the ship handling device 7 is used for driving the side thruster 6. When the side thruster controller 11 is operated to turn ON, the motor 6*b* of the side thruster 6 is rotated in a desired rotation direction in such a manner that the propeller 6*a* of the side thruster 6 generates the thrust in the left and right direction.

The ECU 12 illustrated in FIG. 1 controls the engine 2. The ECU 12 stores various programs and data for controlling the engine 2. The ECU 12 is provided to each of the engines 2. The ECU 12 may have a configuration in which a CPU, a ROM, a RAM, and an HDD are connected to each other through a bus, or may have a configuration including a one-chip LSI and the like.

The ECU 12 is connected to a fuel adjustment valve for a fuel supply pump, a fuel injection valve, various sensors, and the like that are unillustrated components of the engine 2, and is capable of controlling a supplied amount with the fuel adjustment valve and opening/closing of the fuel injection valve and of acquiring information detected by the various sensors.

The ship handling control device 13 as a part of the ship handling device 7 controls the engine 2, the switching clutch 3, and the side thruster 6 based on a detected signal from the acceleration lever 8, the steering wheel 9, the joystick lever 10, and the like. The ship handling control device 13 may be configured to be capable of implementing what is known as automatic navigation in which the ship is automatically handled with a route calculated from the current position and the set destination, based on the information from the Global Positioning System (GPS).

The ship handling control device 13 stores various programs and data for controlling the engine 2, the switching clutch 3, and the side thruster 6. The ship handling control device 13 may have a configuration in which a CPU, a ROM, a RAM, and an HDD are connected to each other through a bus, or may have a configuration including a one-chip LSI and the like.

The ship handling control device 13 is connected to each of the switching clutches 3 and the ECU 12 for each of the engines 2, and can acquire a state of each of the switching clutches 3, a starting state of each of the engines 2, and an engine 2 rotation speed N and various signals acquired by the ECU 12 from the various sensors.

The ship handling control device 13 can transmit a signal, for changing (switching) a clutch state, to each of the switching clutches 3.

The ship handling control device 13 can transmit a signal, for controlling the fuel adjustment valve and the fuel injection valve of the fuel supply pump as well as various other devices of the engine 2, to the ECU 12.

The ship handling control device 13 is connected to the side thruster controller 11 for the side thruster 6 and can transmit a signal for controlling the side thruster 6.

The ship handling control device 13 is connected to the acceleration lever 8 and the joystick lever 10, and can acquire signals from the acceleration lever 8 and the joystick lever 10.

A control mode of a correction for a lateral movement performed with the ship handling control device 13 in the ship 100 as the first embodiment of a ship according to the present invention is described below with reference to FIG. 4 and FIG. 5.

Figure 4:
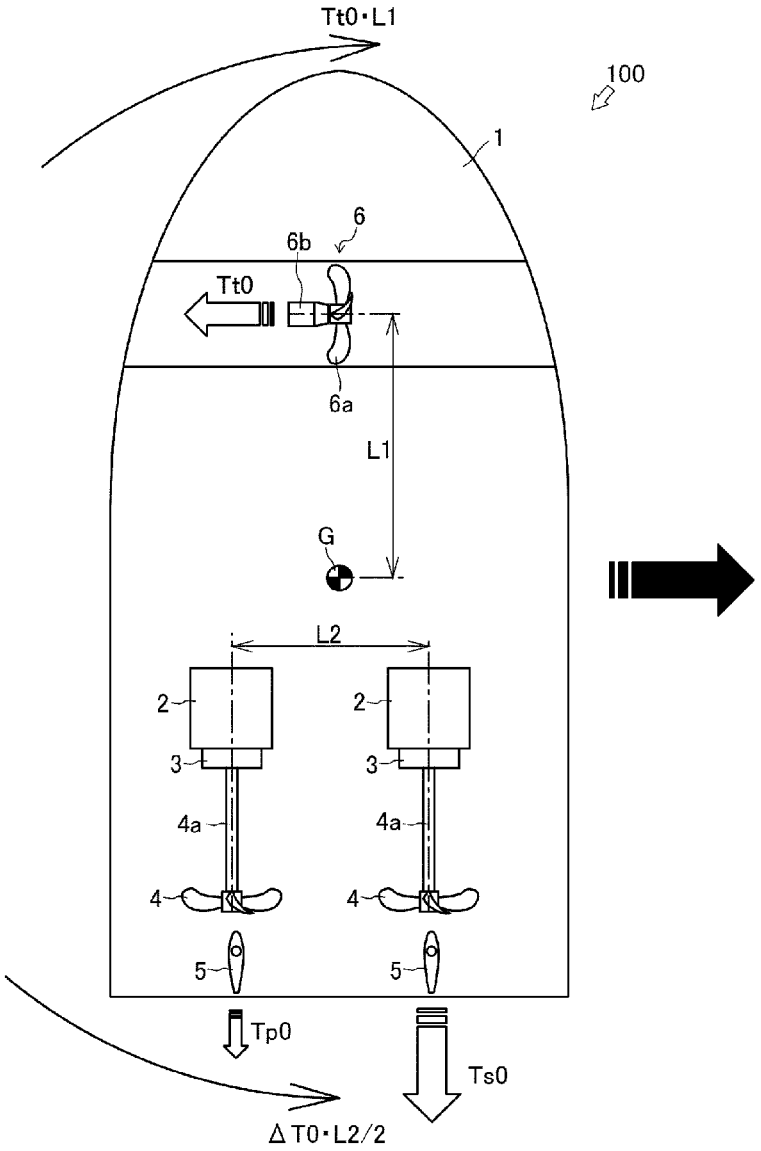
FIG. 4 is a schematic plan view illustrating how thrust is generated by the side thruster and the forward/backward propeller, while the ship including the ship handling device according to the present invention is laterally moving.

As illustrated in FIG. 4, the side thruster 6 is provided at a position that is distant from the center of gravity G of the ship body 1 of a certain shape by a distance to center of gravity L1 toward the bow. The port side and the starboard side forward/backward propellers 4 are disposed on a stern side while being apart from each other by an inter-shaft distance L2.

Formula 1 described below represents a balance between moments about the center of gravity corresponding to thrust Tt0 generated by the side thruster 6 and to thrust Tp0 generated by the port side forward/backward propeller 4 and thrust Ts0 generated by the starboard side forward/backward propeller 4, in the ship 100. Formula 2 and Formula 3 represent a relationship between the thrust Tp0 and the thrust Ts0, with reference thrust T0 representing an average value of the thrust Tp0 and the thrust Ts0, and ΔT0 representing a thrust difference between the thrust Tp0 and the thrust Ts0. Thus, the thrust difference ΔT0 is described as a function of the thrust Tt0 with a first correction coefficient C1 representing a ratio between the distance to center of gravity L1 and the inter-shaft distance L2, as can be seen in Formula 4.

$$Tt0 \cdot L1 = (Ts0 - Tp0) \cdot L2/2 \quad \text{[Formula 1]}$$

$$Tp0 = T0 - \Delta T0 \quad \text{[Formula 2]}$$

$$Ts0 = T0 + \Delta T0 \quad \text{[Formula 3]}$$

$$\Delta T0 = L1/L2 \cdot Tt0 \quad \text{[Formula 4]}$$

A correction procedure in the lateral movement mode for correcting the lateral movement is described in detail below. A rotation moment (Tt0·L1) acts on the ship 100 laterally moving with the thrust Tt0 generated by the side thruster 6, due to the positional relationship between the side thruster 6 and the center of gravity G of the ship body 1 (see a thin arrow on the bow side in FIG. 4). Thus, the ship handling control device 13 generates a rotation moment (ΔT0·L2/2) in accordance with a signal from the joystick lever 10 for canceling out the rotation moment (Tt0·L1) (see a thin arrow on the stern side). Thus, the ship 100 moves in a lateral direction (see a black arrow in FIG. 4).

The relationship between the thrust Tt0 generated by the side thruster 6 and the thrust difference ΔT0 between the port side and the starboard side forward/backward propellers 4 is defined with the first correction coefficient C1 as a ratio (L1/L2) between the distance to center of gravity L1 and the inter-shaft distance L2, as can be seen in Formula 4. When the position of the center of gravity G of the ship body 1 is unknown, the first correction coefficient C1 is calculated from the thrust difference ΔT0, between the thrust Tp0 generated by the port side forward/backward propeller 4 at a rotation speed Np0 and the thrust Ts0 generated by the starboard side forward/backward propeller 4 at a rotation speed Ns0, required for canceling out the rotation moment generated by the thrust Tt0 generated by the side thruster 6 at the rotation speed Ns0, and from the thrust Tt0.

Next, the control mode for correcting the lateral movement in the ship handling device 7 according to the present invention is described in detail.

Figure 5:
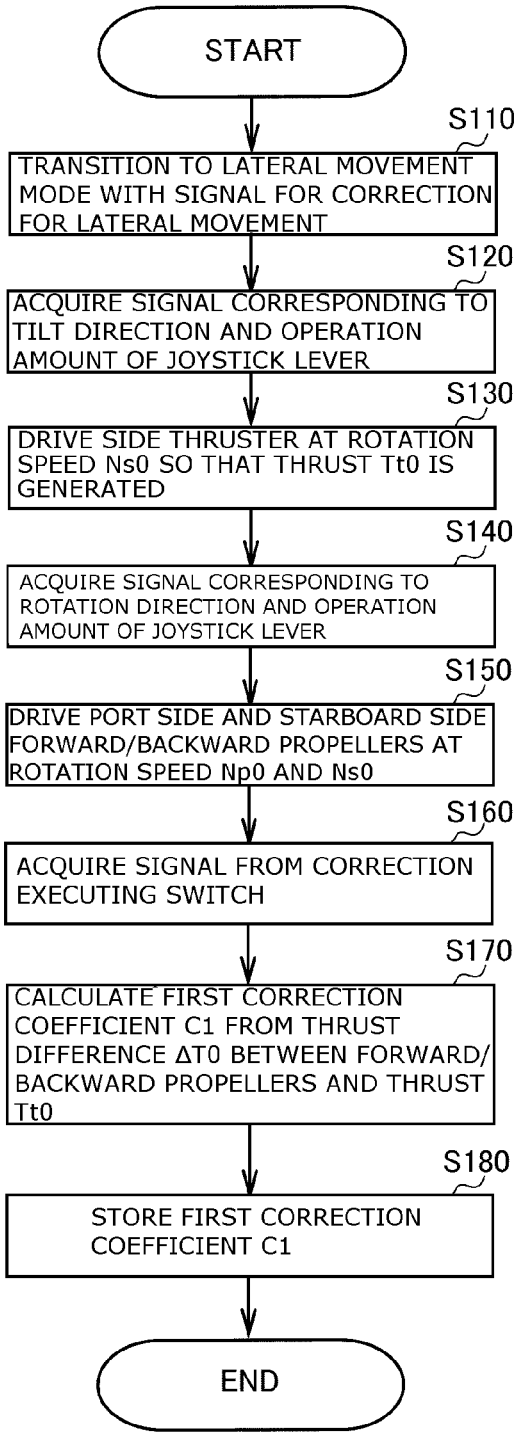
FIG. 5 is a flowchart illustrating a control mode for correction for the lateral movement of the ship including the ship handling device according to the present invention.

As illustrated in FIG. 5, in step S110, the ship handling control device 13 that has acquired a signal for performing correction for the lateral movement from the joystick lever 10 transitions to the lateral movement mode for performing the correction for the lateral movement, and the processing proceeds to step S120.

In step S120, the ship handling control device 13 acquires a signal corresponding to a tilt direction and the operation amount of the tilting operation on the joystick lever 10, and the processing proceeds to step S130.

In step S130, the ship handling control device 13, which has acquired a signal indicating that the joystick lever 10 has been operated to be tilted toward desired one left and right direction, drives the side thruster 6 at the rotation speed Ns0 so that the predetermined thrust Tt0 is generated as a lateral movement thrust in the direction opposite to the tilted direction of the joystick lever 10 as the one left and right direction. Then, the processing proceeds to step S140.

In step S140, the ship handling control device 13 acquires a signal corresponding to a rotating operation direction and the operation amount of the rotating operation on the joystick lever 10 about the lever shaft for canceling out the rotation moment generated by the thrust Tt0 generated by the side thruster 6. Then, the processing proceeds to step S150.

In step S150, the ship handling control device 13 rotates the port side forward/backward propeller 4 at the rotation speed Np0 for generating the thrust Tp0 and rotates the starboard side forward/backward propeller 4 at the rotation speed Ns0 for generating the thrust Ts0 with a rotation speed difference ΔN1 between the speeds, in accordance with the rotating operation direction and the operation amount of the joystick lever 10, in such a manner that the thrust difference ΔT0 is generated between the port side and the starboard side forward/backward propellers 4. Then, the processing proceeds to step S160.

In step S160, the ship handling control device 13 acquires a signal from the correction executing switch 10*c*, and the processing proceeds to step S170.

In step S170, the ship handling control device 13 calculates the first correction coefficient C1 with Formula 4 based on the thrust Tt0 generated by the side thruster 6 and the thrust difference ΔT0 between the thrust Tp0 of the port side forward/backward propeller 4 and the thrust Ts0 of the starboard side forward/backward propeller 4. Then, the processing proceeds to step S180.

In step S180, the ship handling control device 13 stores the calculated first correction coefficient C1, and the processing is terminated.

With the configuration described above, even when the position of the side thruster 6 with respect to the center of gravity position of the ship 100 or the shape of the ship body 1 is unknown, the thrust difference ΔT0 between the port side forward/backward propeller 4 and the starboard side forward/backward propeller 4 is set based on the thrust Tt0 generated by the side thruster 6, by performing rotating operation on the joystick lever 10 in such a manner as to cancel out the rotation moment involved in the lateral movement. Thus, a predetermined correction coefficient can be easily determined, regardless of the positional relationship between the side thruster 6 and the forward/backward propeller 4 and the center of gravity of the ship 100 and regardless of the shape of the ship body 1.

A control mode of an oblique movement mode of the ship handling device 7 according to the present invention is described below with reference to FIGS. 6A-6C and FIG. 7. In the present embodiment, it is assumed that the lateral movement mode has been performed and thus the first correction coefficient C1 has been calculated.

Figure 6A:
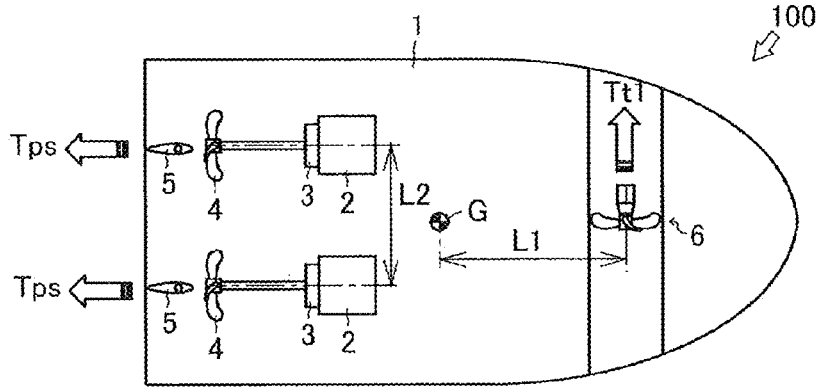
FIG. 6(A) is a schematic plan view illustrating a mode of thrust generated by the side thruster and the forward/backward propeller corresponding to an operation on the joystick lever when the ship including the ship handling device according to the present invention makes an oblique movement.

As illustrated in FIG. 6(A), when the tilting operation is performed on the joystick lever 10 in a desired oblique direction, the ship 100 is moved in the oblique direction by: thrust Tt1 as a left and right direction force component of the oblique movement thrust generated by the side thruster 6 in accordance with an operation amount of the joystick lever 10 in the left and right direction; and thrust Tps as a forward and backward direction force component of the oblique movement thrust generated by the forward/backward propellers 4 on both sides in accordance with the operation amount of the joystick lever 10 in the forward and backward direction. In this process, the rotation moment due to the positional relationship between the side thruster 6 and the center of gravity G of the ship body 1 and a rotation moment due to a resistance of water against the ship body 1 of the ship 100 moving obliquely act on the ship 100.

Figure 6B:
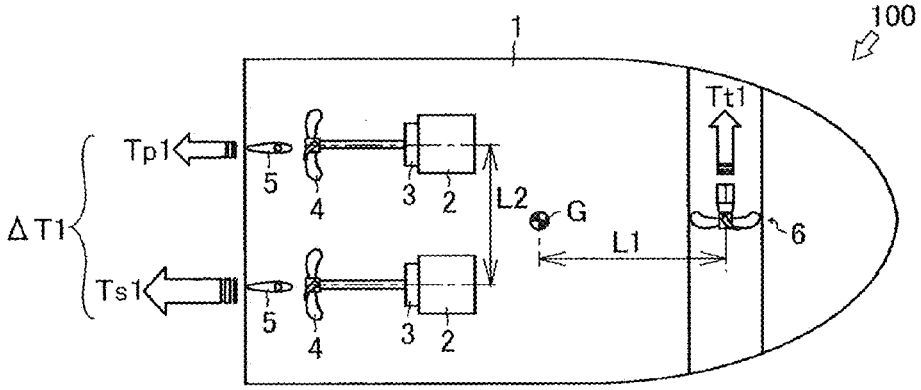
FIG. 6(B) is a schematic plan view illustrating of a mode of thrust generated by the side thruster and the forward/backward propeller when the ship including the ship handling device according to the present invention makes the oblique movement.

As illustrated in FIG. 6(B), the ship handling control device 13 performs calculation based on the first correction coefficient C1 determined by the correction on the lateral movement, and the thrust Tt1 generated by the side thruster 6 at a rotation speed Nt1. Thus, a first correction thrust, for canceling out the moment generated by the side thruster 6, is calculated as a thrust difference ΔT1 based on the rotation speed difference ΔN1 between a rotation speed Np1 of the port side forward/backward propeller 4 and a rotation speed Ns1 of the starboard side forward/backward propeller 4.

Figure 6C:
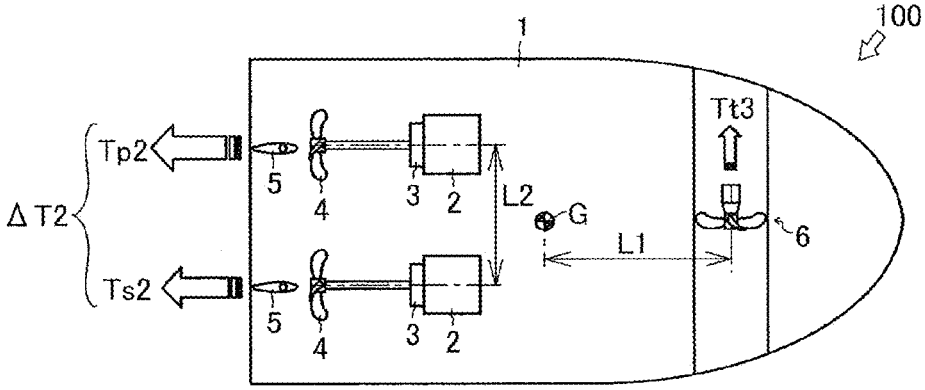
FIG. 6(C) is a schematic plan view illustrating a mode of thrust generated by the side thruster and the forward/backward propeller for canceling out a rotation moment due to water acting on the ship including the ship handling device according to the present invention making the oblique movement.

Similarly, as illustrated in FIG. 6(C), the ship handling control device 13 calculates a second correction thrust as a thrust difference ΔT2 between thrust Tp2 generated by the port side forward/backward propeller 4 and thrust Ts2 generated by the starboard side forward/backward propeller 4 that correspond to the rotation direction and the operation amount of the joystick lever 10 operated to cancel out the moment due to the resistance of water against the ship body 1. Then, a third correction thrust is calculated as thrust Tt3 generated by the side thruster 6 at a rotation speed Nt3 in accordance with the rotation direction and the operation amount of the joystick lever 10.

The ship handling control device 13 calculates a second correction coefficient C2 from the thrust difference ΔT2 as the second correction thrust and reference thrust T1 as an average value of thrust Tp1 generated by the port side forward/backward propeller 4 and thrust Ts1 generated by the starboard side forward/backward propeller 4 as the forward and backward direction force component. Then, a third correction coefficient C3 is calculated from the thrust Tt1 generated by the side thruster 6 as the left and right direction force component and the thrust Tt3 as the third correction thrust.

Next, a control mode of the correction for the oblique movement in the ship handling device 7 according to the present invention is described in detail.

Figure 7:
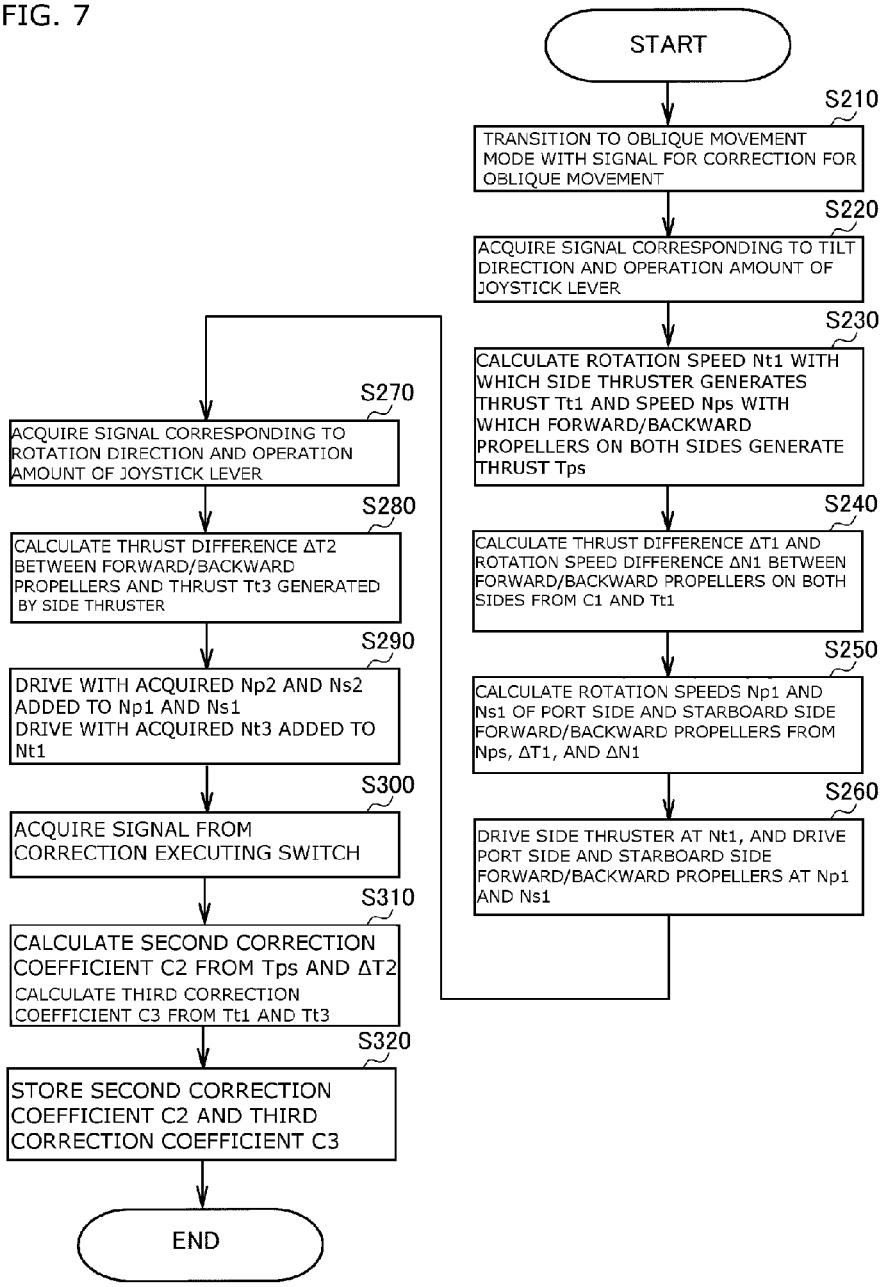
FIG. 7 is a flowchart illustrating a control mode for correction for the oblique movement of the ship including the ship handling device according to the present invention.

As illustrated in FIG. 7, in step S210, the ship handling control device 13 that has acquired a signal for performing the correction for the oblique movement from the joystick lever 10 transitions to the oblique movement mode for performing the correction for the oblique movement. Then, the processing proceeds to step S220.

In step S220, the ship handling control device 13 acquires a signal corresponding to the tilt direction and the operation amount of the tilting operation on the joystick lever 10. Then, the processing proceeds to step S230.

In step S230, the ship handling control device 13 calculates the rotation speed Nt1 of the side thruster 6 with which the side thruster 6 generates the thrust Tt1 corresponding to the operation amount of the joystick lever 10 in the left and right direction, and calculates a rotation speed Nps of the forward/backward propellers 4 on both sides with which the forward/backward propellers 4 on both sides generate the thrust Tps corresponding to the operation amount in the forward and backward direction. Then, the processing proceeds to step S240.

In step S240, the ship handling control device 13 calculates the first correction thrust as the thrust difference ΔT1 based on the rotation speed difference ΔN1 between the forward/backward propellers 4 on both sides for canceling out the rotation moment generated by the side thruster 6, from the determined first correction coefficient C1 and the calculated thrust Tt1 generated by the side thruster 6 at the rotation speed Nt1. Then, the processing proceeds to step S250.

In step S250, the ship handling control device 13 calculates the rotation speed Np1 of the port side forward/backward propeller 4 with the thrust Tp1 and the rotation speed Ns1 of the starboard side forward/backward propeller 4 with the thrust Ts1, from the rotation speed Nps, the thrust difference ΔT1, and the rotation speed difference ΔN1 of the forward/backward propellers 4 on both sides calculated as described above. Then, the processing proceeds to step S260.

In step S260, the ship handling control device 13 drives the side thruster 6 at the rotation speed Nt1, drives the port side forward/backward propeller 4 at the rotation speed Np1, and drives the starboard side forward/backward propeller 4 at the rotation speed Ns1. Then, the processing proceeds to step S270.

In step S270, the ship handling control device 13 acquires a signal corresponding to the rotation direction and the operation amount of the joystick lever 10 operated to cancel out the moment due to the resistance of water against the ship body 1. Then, the processing proceeds to step S280.

In step S280, the ship handling control device 13 calculates the second correction thrust as the thrust difference ΔT2 between the thrust Tp2 and the thrust Ts2 respectively generated by the port side forward/backward propeller 4 at a rotation speed Np2 and the starboard side forward/backward propeller 4 at a rotation speed Ns2, corresponding to the rotating operation direction and the operation amount of the joystick lever 10, and calculates the third correction thrust as the thrust Tt3 generated by the side thruster 6 at the rotation speed Nt3 corresponding to the rotation direction and the operation amount of the joystick lever 10. Then, the processing proceeds to step S290.

In step S290, the ship handling control device 13 adds the thrust difference ΔT2 as the second correction thrust to the thrust difference ΔT1 as the first correction thrust. Thus, the forward/backward propellers 4 on both sides are driven with the rotation speed Np2 for generating the thrust Tp2 added to the rotation speed Np1 of the port side forward/backward propeller 4 and with the rotation speed Ns2 for generating the thrust Ts2 added to the rotation speed Ns1 of the starboard side forward/backward propeller 4. Furthermore, the thrust Tt3 as the third correction thrust is added to the thrust Tt1 of the side thruster 6. Thus, the side thruster 6 is driven with the rotation speed Nt3 for generating the thrust Tt3 added to the rotation speed Nt1 of the side thruster 6. Then, the processing proceeds to step S300.

In step S300, the ship handling control device 13 acquires the signal from the correction executing switch 10*c*. Then, the processing proceeds to step S310.

In step S310, the ship handling control device 13 calculates the second correction coefficient C2 from the thrust difference ΔT2 as the second correction thrust and the thrust Tps generated by the forward/backward propellers 4 on both sides as the forward and backward direction force component, and calculates the third correction coefficient C3 from the thrust Tt3 as the third correction thrust and the thrust Tt1 of the side thruster 6 as the left and right direction force component. Then, the processing proceeds to step S320.

In step S320, the ship handling control device 13 stores the second correction coefficient C2 and the third correction coefficient C3 thus calculated, and the processing is terminated.

With the configuration described above, even when the position of the side thruster 6 with respect to the center of gravity position of the ship 100 or the shape of the ship body 1 is unknown, the thrust Tt3 generated by the side thruster 6 and the thrust difference ΔT2 between the port side forward/backward propeller 4 and the starboard side forward/backward propeller 4 are set based on the thrust Tt1 generated by the side thruster 6 and the thrust Tps generated by the forward/backward propeller 4, by performing rotating operation on the joystick lever 10 in such a manner as to cancel out the rotation moment involved in the oblique movement. Thus, the predetermined correction coefficient can be easily determined, regardless of the positional relationship between the side thruster 6 and the forward/backward propeller 4 and the center of gravity of the ship 100 and regardless of the shape of the ship body 1.

INDUSTRIAL APPLICABILITY

The present invention can be applied to a technique of a ship handling device for a ship with a side thruster in which power is transmitted to a forward/backward propeller from a transmission disposed in a ship body, via a propeller shaft.

REFERENCE SIGNS LIST

1 ship body
2 engine
4 forward/backward propeller
4*a* propeller shaft
6 side thruster
10 joystick lever
100 ship
ΔT1 first correction thrust
C1 first correction coefficient

The invention claimed is:

1. A ship handling device for a ship being disposed in a ship body, and provided with a forward/backward propeller for generating thrust in forward and backward direction of the ship by power transmitted from an engine via a propeller shaft and with a side thruster for generating thrust in left and right direction of the ship, and comprising: a joystick lever for indicating a propulsion direction of the ship and magnitude of thrust by way of a tilt direction and a tilt angle and indicating a direction and magnitude of moment generated by the ship from thrust by way of a rotation direction and a rotation amount, wherein a lateral movement thrust is generated by the side thruster in accordance with a tilting operation of the joystick lever in one left and right direction, a first correction thrust is generated by the forward/backward propeller in accordance with a rotating operation of the joystick lever so as to cancel out a moment generated by the lateral movement thrust, and a first correction coefficient for calculating a first correction thrust with respect to the lateral movement thrust is determined.

2. The ship handling device according to claim 1, wherein a left and right direction force component of oblique movement thrust generated by the side thruster is generated in accordance with an operation amount in a left and right direction in the tilting operation on the joystick lever in a desired oblique direction, and a forward and backward direction force component of oblique movement thrust generated by the forward/backward propeller is generated in accordance with an operation amount in the forward and backward direction in the tilting operation on the joystick lever in the desired oblique direction, wherein the first correction thrust based on the first correction coefficient is further generated by the forward/backward propeller with respect to the left and right direction force component, and second correction thrust is further generated by the forward/backward propeller and third correction thrust is further generated by the side thruster in accordance with a rotating operation performed on the joystick lever for canceling out a moment generated by an oblique movement of the ship, and wherein a second correction coefficient for calculating a second correction thrust with respect to forward and backward direction force component and a third correction coefficient for calculating a third correction thrust with respect to left and right direction force component are determined.

* * * * *